US007575261B2

(12) United States Patent
Gagne et al.

(10) Patent No.: US 7,575,261 B2
(45) Date of Patent: Aug. 18, 2009

(54) CARRIER FOR A PAINT TRAY

(75) Inventors: Larry Steven Gagne, Pembroke (CA); Chuck Martin, Saint John (CA)

(73) Assignee: T.S. Simms & Co. Limited, Saint John, MO (US)

( * ) Notice: Subject to any disclaimer, the term of this patent is extended or adjusted under 35 U.S.C. 154(b) by 226 days.

(21) Appl. No.: 11/419,094

(22) Filed: May 18, 2006

(65) Prior Publication Data

US 2006/0261231 A1 Nov. 23, 2006

Related U.S. Application Data

(63) Continuation-in-part of application No. 10/841,170, filed on May 7, 2004, now Pat. No. 7,194,786.

(51) Int. Cl.
*B65G 7/12* (2006.01)

(52) U.S. Cl. ..... 294/34; 294/168; 248/295.11; 16/422; 16/425; 220/757; 220/759

(58) Field of Classification Search ..... 294/34, 294/27.1, 32, 31.1, 162; 16/422, 425, 426, 16/427; 220/757, 759, 696; 15/145; 248/181.1, 248/181.2, 276.1, 288.31
See application file for complete search history.

(56) References Cited

U.S. PATENT DOCUMENTS

| | | | | |
|---|---|---|---|---|
| 1,177,205 | A * | 3/1916 | Mullin | 294/34 |
| 2,527,847 | A * | 10/1950 | Plitt | 294/34 |
| 2,541,390 | A * | 2/1951 | Weigand | 248/210 |
| 2,542,737 | A | 2/1951 | Vogel | |
| 2,613,860 | A * | 10/1952 | Hoffman | 294/162 |
| 2,709,540 | A * | 5/1955 | Kenney | 141/328 |
| 2,992,848 | A * | 7/1961 | Livensparger | 294/34 |
| 3,013,286 | A * | 12/1961 | Barreca | 12/120.5 |
| 3,108,776 | A | 10/1963 | Cook | |
| 3,414,311 | A * | 12/1968 | Trimboli | 294/34 |
| 3,947,135 | A | 3/1976 | Hawk | |
| 4,025,205 | A | 5/1977 | Hawk | |

(Continued)

FOREIGN PATENT DOCUMENTS

| | | |
|---|---|---|
| CA | 1081145 | 7/1980 |

(Continued)

OTHER PUBLICATIONS

Alta Vista—Babel Fish Translation—Translated Text, 1 page, English translation of the Title in French given in FR 2333584; http://babelfish.altavista.com/tr, Nov. 10, 2004.

*Primary Examiner*—Amy J. Sterling
(74) *Attorney, Agent, or Firm*—Senniger Powers LLP

(57) ABSTRACT

A carrier for a paint tray is provided, the tray having an inner wall defining a container for containing paint and an outer wall for supporting the container, the inner and outer walls defining a space therebetween accessible from underneath the tray. The carrier comprises a base with a front leg for coupling to the paint tray and a lifting member connected to the base. The front leg may be inserted into the space between said inner and outer wall and can engage the interior faces of both said inner and outer walls simultaneously when inserted into said space to secure the member within the space and to support the tray from the front leg.

11 Claims, 9 Drawing Sheets

U.S. PATENT DOCUMENTS

| | | | | |
|---|---|---|---|---|
| 4,085,877 | A | 4/1978 | Hildebrand | |
| 4,167,348 | A | 9/1979 | Hawk | |
| 4,823,975 | A * | 4/1989 | Schwankl | 220/740 |
| 4,890,353 | A | 1/1990 | Shannon et al. | |
| 5,062,607 | A | 11/1991 | Kisner | |
| 5,113,549 | A | 5/1992 | Villiano | |
| 5,584,520 | A * | 12/1996 | Niemeier | 294/34 |
| 5,996,952 | A | 12/1999 | Heywood | |
| 6,102,458 | A * | 8/2000 | Scace | 294/34 |
| 6,494,417 | B1 | 12/2002 | Gizzi | |
| 6,609,685 | B1 | 8/2003 | Lamont | |
| 2004/0159752 | A1 | 8/2004 | Vukas | |

FOREIGN PATENT DOCUMENTS

| | | |
|---|---|---|
| CA | 1221057 | 4/1987 |
| CA | 2019101 | 12/1991 |
| CA | 2049600 | 2/1993 |
| CA | 2160168 | 4/1997 |
| CA | 2428358 | 11/2004 |
| FR | 2333584 | 7/1997 |
| WO | 0242007 | 5/2002 |

* cited by examiner

CARRIER FOR A PAINT TRAY

CROSS-REFERENCE TO RELATED APPLICATIONS

This application is a continuation-in-part of U.S. patent application Ser. No. 10/841,170.

BACKGROUND OF THE INVENTION

The present invention relates to a carrier which can be attached to a paint tray to improve the portability of the tray.

Examples of known carriers for paint trays or pans are described in U.S. Pat. No. 5,113,549 issued on 19 May, 1992 to M. J. Villiano and Canadian Patent No. 2,160,168 issued on 27 Jan. 1998 to Guy Samson. These carriers include a single upstanding arm which extends over a paint tray, when in use, and a coupler for coupling the arm to the tray. The coupler described in Villiano comprises a clamp which acts between the underside of the tray and the upper edge of the tray wall. The coupler disclosed in Samson engages with a special receptacle provided at the end of a paint tray and which is accessible from above. Samson also discloses an alternative coupler comprising a pair of vertically spaced clips which clip to upper and lower edges of the side wall.

However, known paint tray carriers have various drawbacks in that they are either incapable of securely and reliably connecting the carrier to a tray, or they require a tray which is specially adapted for coupling to the carrier.

SUMMARY OF THE INVENTION

According to one aspect of the present invention, there is provided a carrier for a paint tray, comprising: a base with an upwardly extending front leg; a lifting member extending upwardly from said base in spaced relation from said front leg, said lifting member meeting said base rearwardly of said front leg, said lifting member having a longitudinal slot; said upwardly extending front leg having a concave front face.

According to another aspect of the present invention, there is provided a carrier for a paint tray of the type having a curved wall defining a container for containing paint and a rim extending from an upper portion of the wall, the carrier comprising: a base with an upwardly extending front leg terminating in a ledge; a lifting member extending upwardly from said base in spaced relation from said front leg; said upwardly extending front leg having a concave front face; said concave front face for engaging said curved wall of the paint tray with said ledge engaging a lower surface of the rim extending from said wall; and a clip for retaining said base in engagement with said tray, said clip sliding in a longitudinal slot of said lifting member.

BRIEF DESCRIPTION OF THE DRAWINGS

Example embodiments of the present invention will now be described with reference to the drawings, in which.

DETAILED DESCRIPTION

Figure 3:
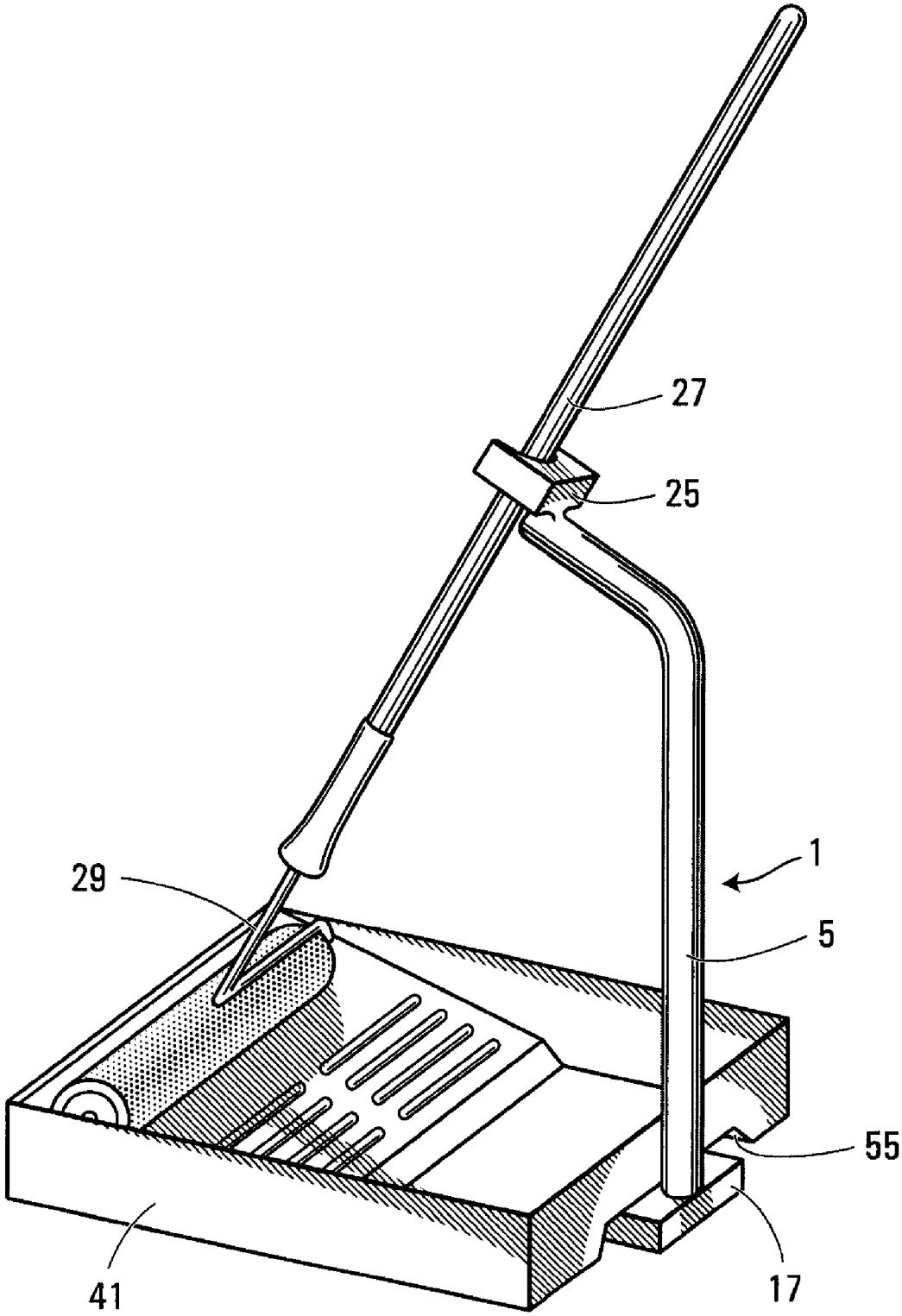
FIG. 3 shows a perspective view of the paint tray carrier of FIG. 1 attached to a first type of paint tray.
Figure 4:
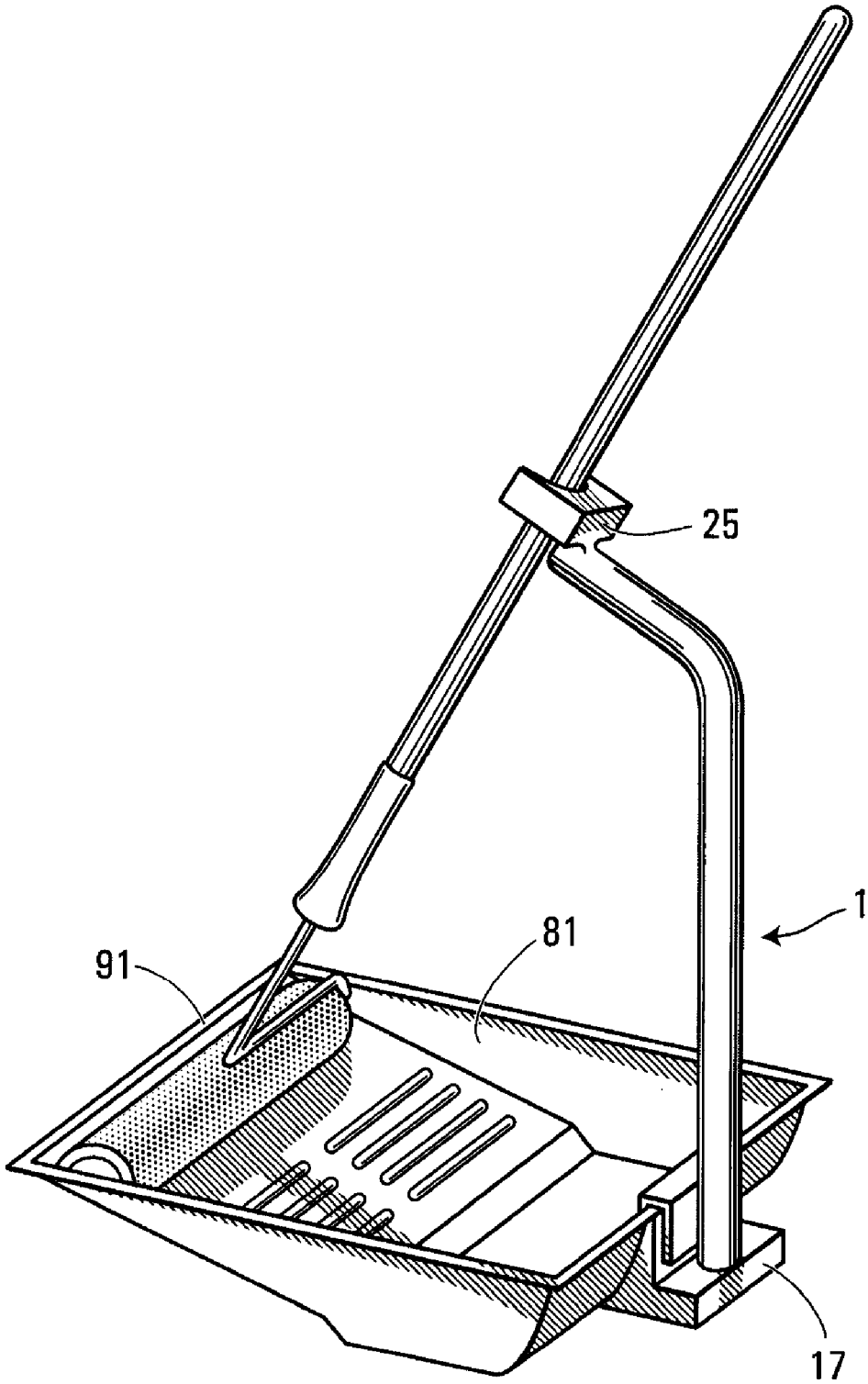
FIG. 4 shows a perspective view of the paint tray carrier of FIG. 1 attached by the clip of FIG. 2 to a paint tray of a second type.
Figure 5:
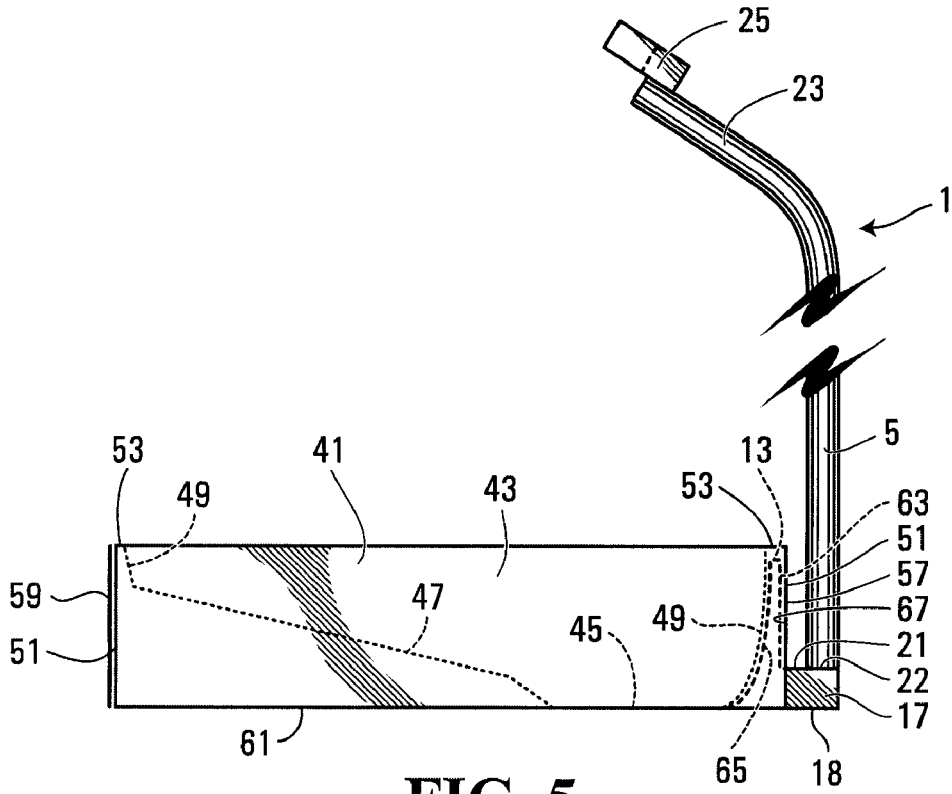
FIG. 5 shows a side view of FIG. 3.
Figure 6:
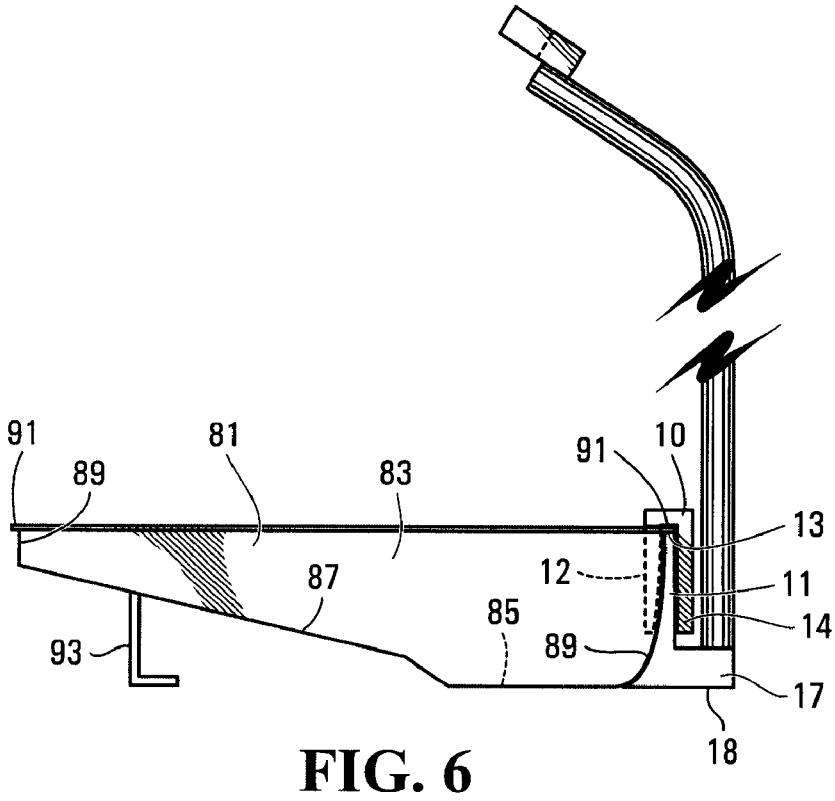
FIG. 6 shows a side view of FIG. 4.

Referring to FIGS. 1 to 6, a carrier 1 according to an embodiment of the present invention for a paint tray comprises a base 3 for coupling to the paint tray and a lifting member 5 extending from the base. The base includes an upwardly extending front leg 7 having a concave front face 9, a substantially vertical rear face 11, and a top ledge 13. The front face 9 of the front leg is shaped so that at least portions of the front face between the top ledge 13 and the bottom 18 of the base can engage the curved wall (FIG. 5: 49 or FIG. 6: 89) of a paint tray, which wall partially defines the paint container of the tray. The base 3 includes a foot 17 which extends rearwardly of the front leg 7 for supporting the paint tray carrier on a floor or other horizontal surface. The lifting member 5 comprises an arm 19 which extends upwardly from the foot 17 and which is connected to the foot rearwardly of the front leg 7. Consequently, the lifting member is in spaced relation from the front leg so that there is a gap 21 between the rear face 11 of the front leg 7 and the arm 19, as shown in FIGS. 5 and 6. Advantageously, in one embodiment, the foot of the carrier is adapted to support the carrier arm 19 in an upright position when detached from a tray and without other assistance to facilitate attachment of the carrier to a paint tray, and in particular to allow a user to set the carrier into an upright position before attaching it to a tray without having to hold the carrier either before or during its attachment to a tray. The foot also assists in stabilizing the tray/carrier assembly, helps to prevent tipping of the tray, and supports the weight of the carrier directly and independently of the tray.

In this embodiment, an upper portion 23 of the lifting arm 19 is angled to extend forward over a paint tray, when the carrier is attached thereto, and includes an end portion with a receptor 25 for supporting the handle 27 of a paint roller 29, as for example shown in FIGS. 3 and 4. In this embodiment, the receptor 25 has lower surfaces 31, 33 which extend on either side of the arm 23 to enable the arm to be lifted by two fingers positioned below the receptor 25. As shown, the receptor is in the nature of a slot for receiving a paint roller handle 27 to prevent sideways movement thereof.

FIGS. 3 to 6 illustrate how the same paint tray carrier according to an embodiment of the present invention can be attached to two different types of paint trays. In particular, FIGS. 3 and 5 show the carrier attached to one type of common paint tray which is generally moulded from a plastic material and FIGS. 4 and 6 show the carrier attached to a paint tray of a common, pressed metal type.

Referring to FIGS. 3 and 5, the first type of paint tray 41 comprises a container 43 having a paint well 45, a ramp 47 (which may include ribs) and an inner wall 49. The paint tray further includes an outer wall 51 which supports the container 43 and which is attached to the upper portion of the inner wall for example by a rim or web 53. A slot 55 (shown in FIG. 3) is formed in the lower part of the rear outer wall 57, and possibly also in the lower part of the front outer wall 59, for accommodating the fingers of a user so that a lower edge of the outer wall is manually accessible to a user when the paint tray is resting on a floor to facilitate lifting and moving the paint tray.

To attach the carrier 1 to tray 41, the bottom edge 61 of the tray is simply raised above the level of the top ledge 13 of the front leg 7, the space 63 between the inner and outer walls 49, 57 of the tray is positioned over the front leg 7 and the tray is then lowered over the front leg so that the front face 9 of the front leg engages the inner face 65 of the inner wall 49 and the rear face 11 of the front leg 7 engages the inner face 67 of the outer wall 51 of the paint tray.

The front leg is preferably adapted to engage both the inner and outer walls of the paint tray simultaneously and fit relatively snugly or tightly therebetween and to prevent any significant rotation of the paint tray about the front leg due to its weight when the carrier is lifted. The front leg 7 should also extend sufficiently into the space so that portions of the front leg which engage the inner and outer walls of the tray are sufficiently spaced apart between the top and bottom of the tray to prevent significant rotation of the tray due its weight when the carrier is lifted.

The front leg may be sized so that when inserted into the space, it moves the inner and outer walls of the container apart, at least slightly, so that the resiliency of the tray walls assist in retaining the front leg within the space when the tray is lifted other than by means of the carrier, without the carrier falling out. The paint tray wall engaging surfaces of the front leg may also be adapted to produce friction with the container walls, again to assist in retaining the front leg within the space and to support the weight of the carrier. Although in one embodiment, the front and rear faces of the front leg may be adapted to substantially conform with the profile of the inner faces of the inner and outer walls of a paint tray, in other embodiments, the front leg may include protrusions, for example resilient protrusions for engaging with the inner faces of the inner and outer walls to allow the front leg to conform to different shapes and profiles of inner and outer walls of different paint trays and different shaped gaps between the inner and outer walls.

Double-walled paint trays may have webs of material which extend within the space between its inner and outer walls thereby forming a bridge connecting the walls together for additional strength. Furthermore, paint trays may have other formations which also extend into the space and which potentially provide an obstruction to inserting the front leg into the space. Embodiments of the front leg may be adapted to avoid these webs or other protrusions by shaping the front leg appropriately, and such shaping may for example include forming slots or recesses within the front leg to accommodate the various protrusions.

The front leg is preferably adapted so that when inserted into the space between the inner and outer walls of a paint tray to the extent necessary to properly secure the carrier to the tray, the lower surface or bottom 18 of the foot lies substantially flush with floor engaging portions of the tray or extends below the tray to some degree so that, when in use, the carrier is independently supported by the floor.

In one embodiment, the upper surface 22 of the foot 17 of the base may be positioned to engage the lower edge of the outer wall of the tray or so that the lower edge is near the upper surface so that the foot can provide additional support for the tray at the lower edge of its outer wall.

Referring to FIGS. 4 and 6, the second type of paint tray 81 with which the carrier 1 may be used comprises a container 83 having a paint well 85, a ramp 87, a curved container wall 89 and a rim 91 extending outwardly from the upper edge of the container wall 89. The tray 81 also includes one or more feet 93 positioned below the ramp 87 for supporting the front end of the tray and to keep the tray level when supported on a horizontal surface.

Figure 1:
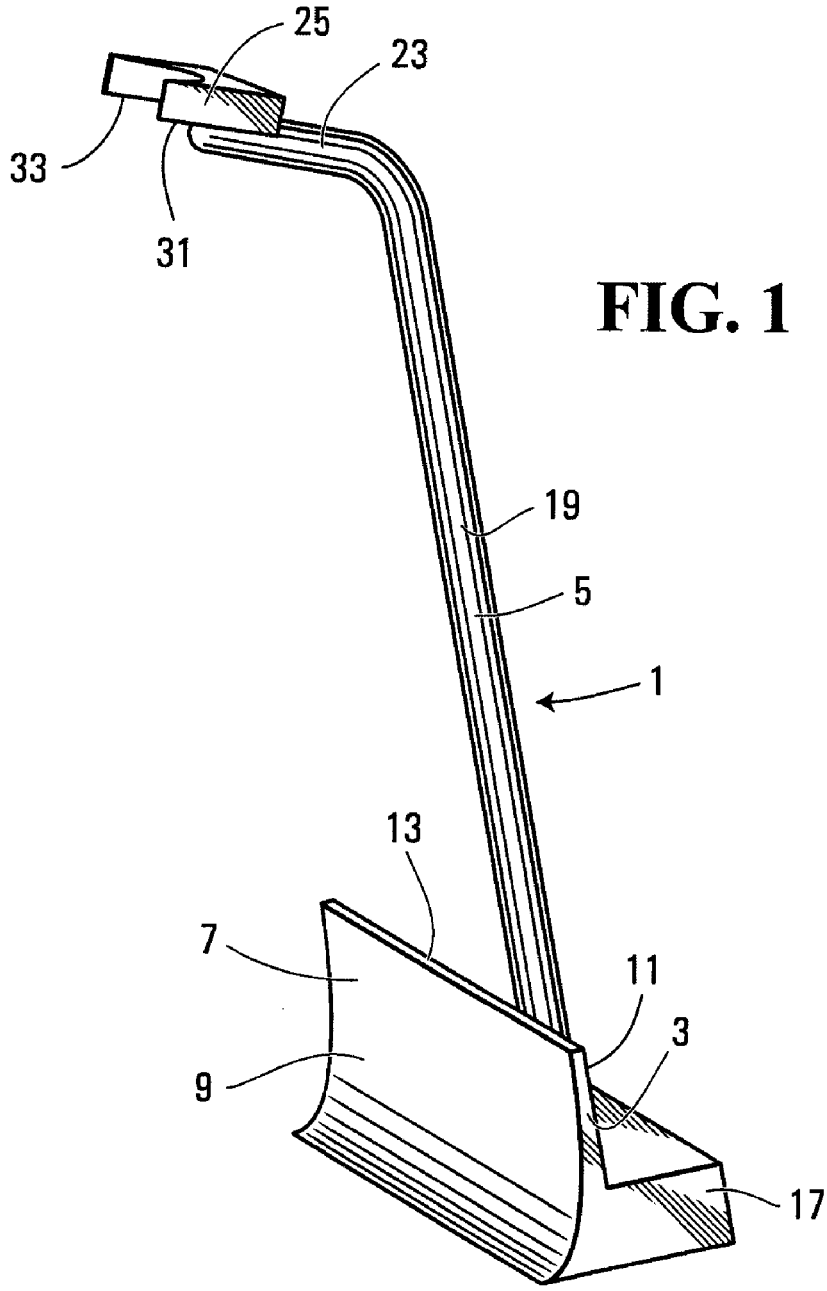
FIG. 1 shows a perspective view of a paint tray carrier according to an embodiment of the present invention.
Figure 2:
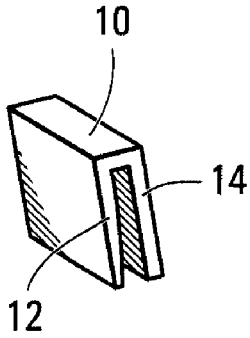
FIG. 2 shows a perspective view of a clip which may be part of the paint tray carrier of FIG. 1.

To attach the carrier 1 to the tray 81, the front leg 7 of the carrier is positioned in abutment with the curved wall 89 of the tray and so that the top ledge 13 of the front leg is positioned underneath the rim 91, as shown in FIG. 6. Thereafter, a clip 10 which is illustrated in FIG. 2, is pushed downwards over the top of the container wall 89 so that one jaw 12 of the clip engages the container wall and the second jaw 14 of the clip engages the rear surface 11 of the front leg 7 to urge and retain the front leg against the container wall.

The strength of the coupling between the tray and the front leg will depend on the resiliency of the clip and also the extent to which the jaws of the clip extend over the wall of the tray and over the rear wall of the front leg. In the present embodiment, the clip extends downwards over a substantial portion of the height of the tray wall and over a substantial portion of the height of the rear wall of the front leg. However, in other embodiments, the jaws of the clip may extend downwards by a lesser or greater degree.

Advantageously, since the clip is free to move up and down by any required extent, not only is attachment of the carrier to the paint tray greatly facilitated over prior arrangements, but the jaws of the clip can be relatively long, thereby substantially increasing the strength of the coupling, again in comparison to prior arrangements where the resiliency of the clip which is responsible for the coupling between the carrier and tray must be sufficiently flexible to allow the clip to be bent manually in order to connect the tray to the carrier.

In this embodiment, the top ledge 13 of the front leg can support the tray from the rim 91. However, in other embodiments the top ledge of the front leg need not engage the rim and the tray may be supported simply by virtue of friction between the tray wall and the front leg when the wall and front leg are forced together by means of a suitable retainer as, for example, clip 10 shown in FIGS. 2, 4 and 6. If necessary, the friction of the surface of the tray and/or front leg may be enhanced by any suitable means, for example, by treating the surface with a suitable treatment or texturing the surface, for example, by knurling or otherwise providing surface structure.

As noted, front leg 7 is concave. In particular, the front lower portion of the front leg 7 generally curves or extends forwards to conform with and engage at least a portion of the curved lower part of the curved container wall which adjoins the floor of the paint well 45, 85. This feature may assist in supporting the tray when lifted by the carrier. It also assists in avoiding play between the carrier and the tray.

As for the embodiment shown in FIG. 5, the carrier is preferably adapted so that it is couplable to the tray in such a manner that its foot 17 lies substantially flush with the floor engaging parts of the tray or extends below the floor engaging parts of the tray so that the carrier can be supported directly by a horizontal bottom surface of the foot and independently of the tray. Advantageously, this helps to stabilize the carrier and tray when connected together and prevents the carrier from imparting a torque to the combined carrier/tray assembly which would increase the risk of the tray tipping.

Although in the embodiments described above, the carrier is shown connected to the rear end of the paint trays, it will be appreciated that the carrier may be connected to any other portion of the paint tray wall, for example, one of the side walls, or the front wall.

Figure 7:
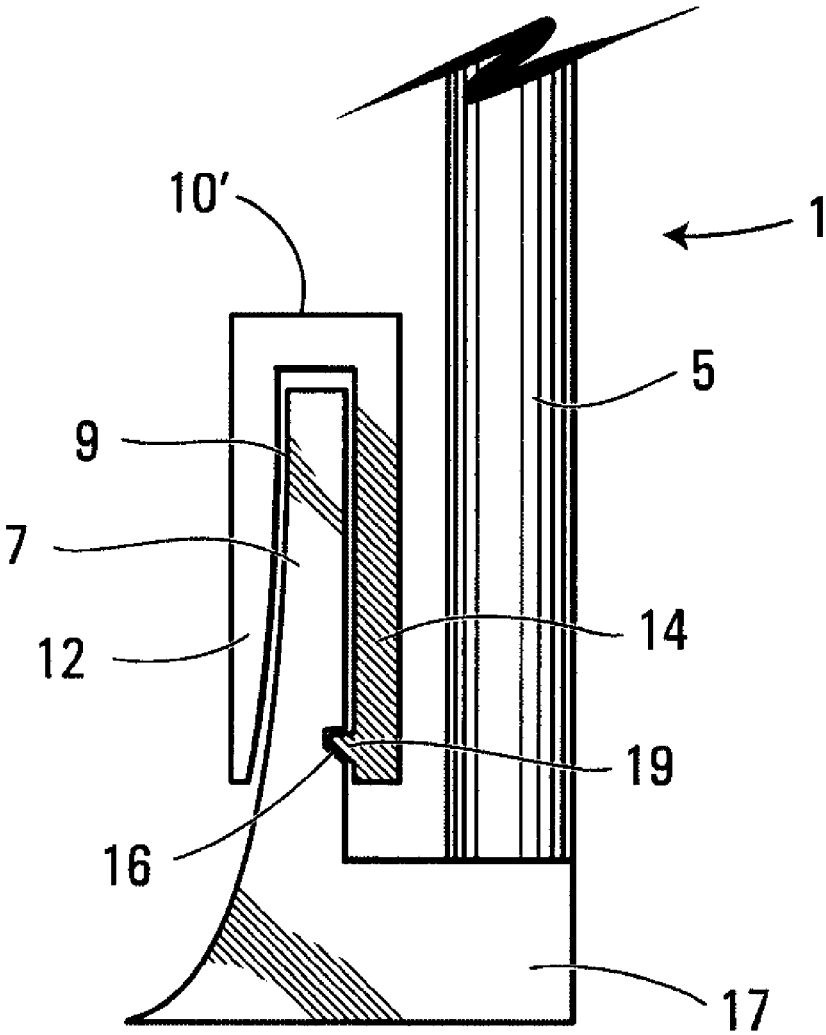
FIG. 7 is a fragmentary view of portion of a paint tray carrier and clip according to an embodiment of the present invention.

FIG. 7 shows an embodiment wherein a clip 10' includes a detent 16 for locking the second jaw 14 of the clip into a notch 19 in the front leg 7. In other embodiments, the detent may be formed on the front leg and the recess formed on the clip. However, this latter arrangement, in which the detent is formed on the front leg, may interfere with the front leg's ability to adapt to double walled paint trays, as shown in FIG. 5 in which the rear face engages with the outer tray wall. In other embodiments, any other form of suitable detent arrangement may be included or a detent arrangement may be omitted altogether.

The clip may be formed from any suitable material including metal, for example sheet metal of a suitable thickness and having the desirable resilience or from a plastics material, or from any other suitable material.

Figure 8:
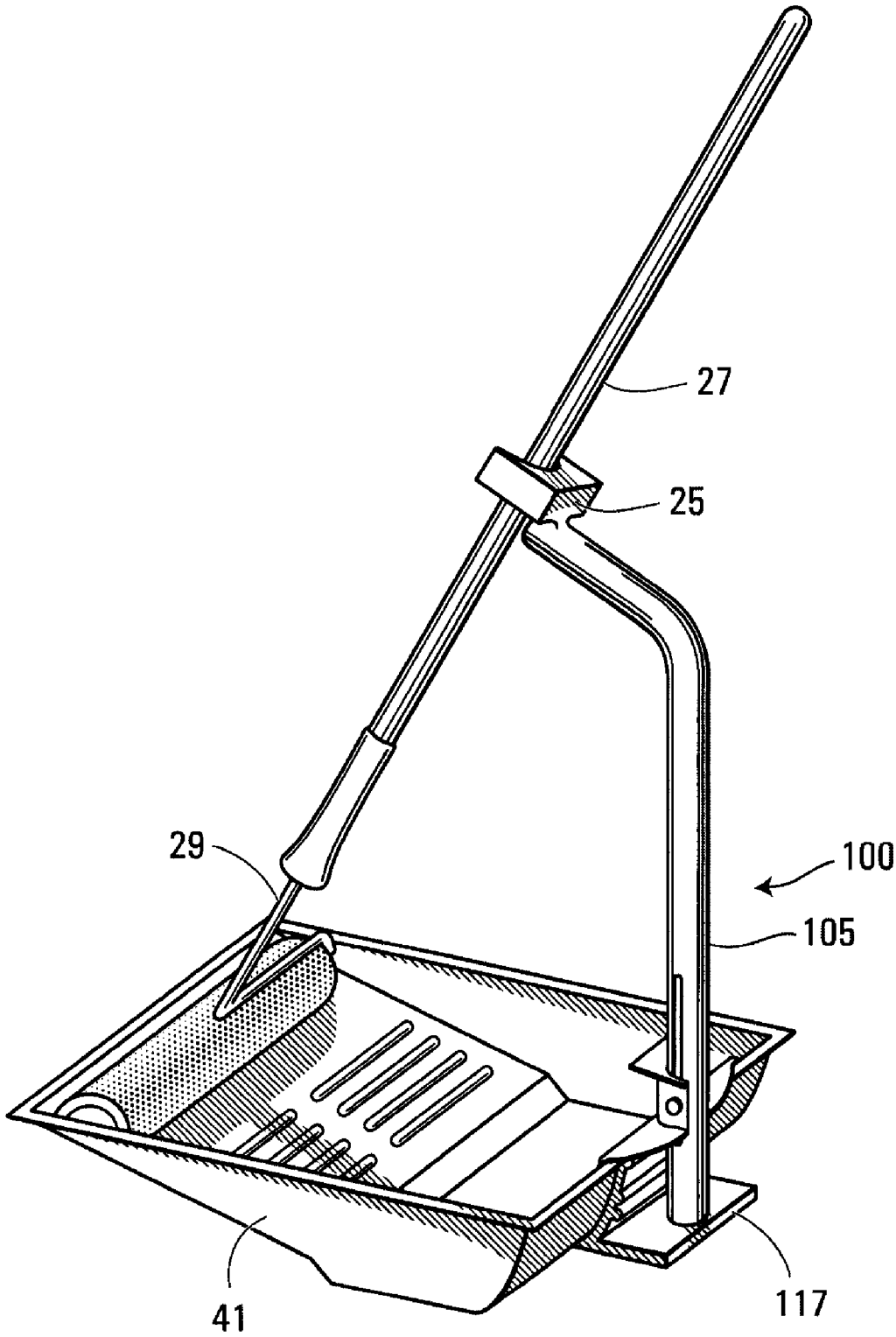
FIG. 8 shows a perspective view of a paint tray carrier made in accordance with a further embodiment of this invention shown attached to the second type of paint tray.
Figure 9:
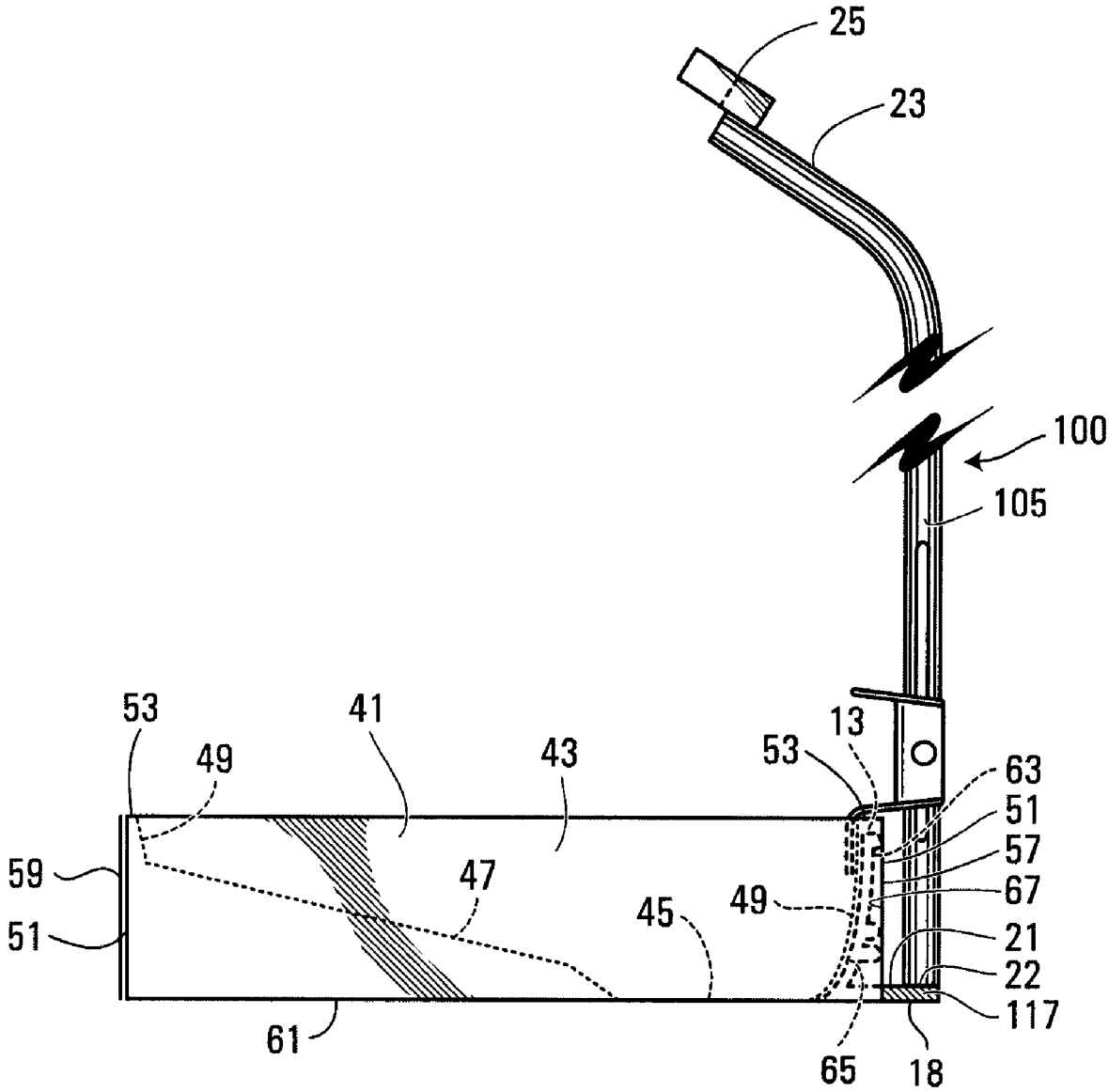
FIG. 9 shows a side view of FIG. 8.
Figure 10:
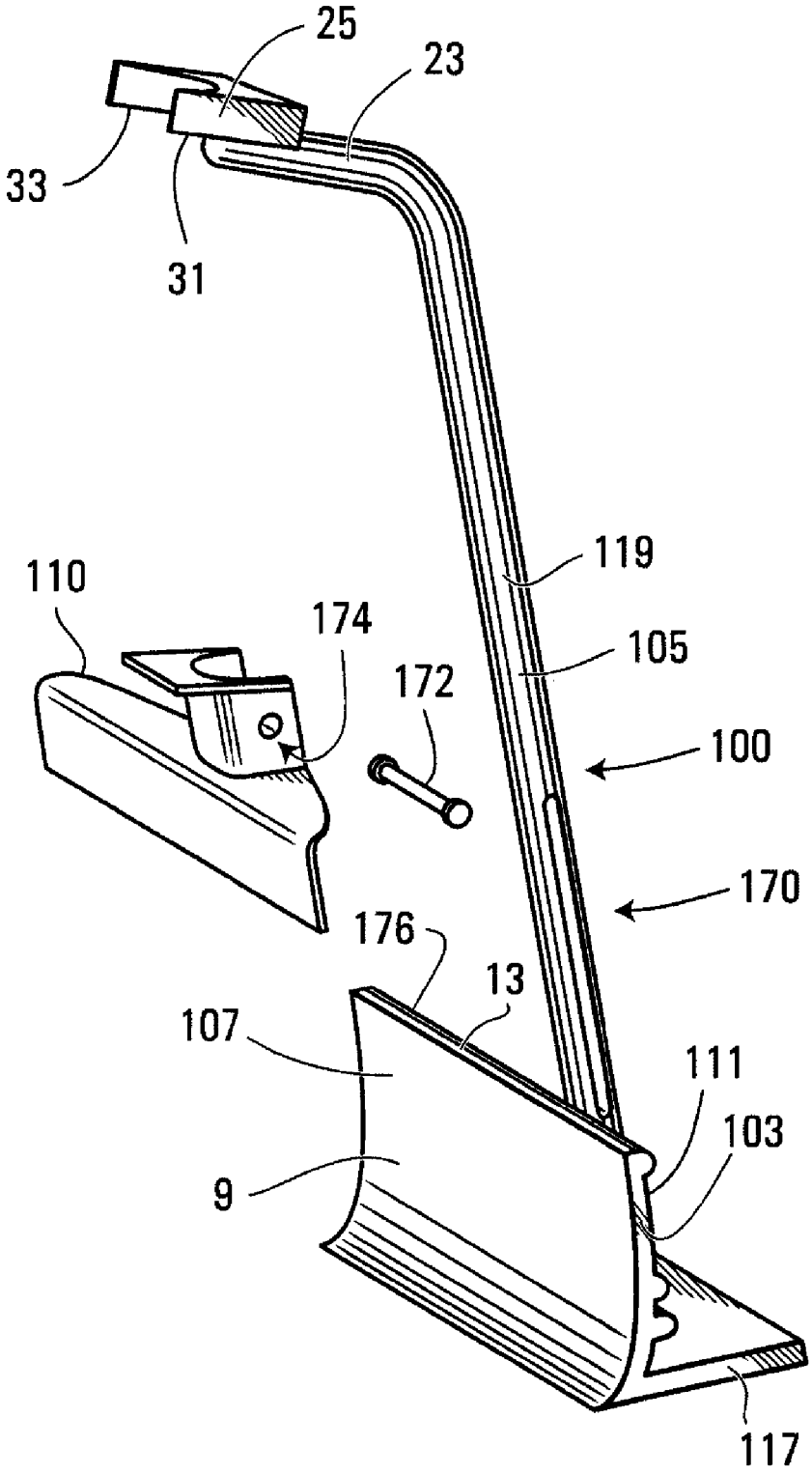
FIG. 10 is an exploded view of the paint tray carrier of FIG. 8.

With reference to FIGS. 8 to 10 wherein like parts have been given like reference numerals, in a further embodiment, the arm 119 of lifting member 105 of carrier 100 may have a slot 170 extending along a portion of its length. A removable pin 172 extends through the slot 170 and openings 174 in L-shaped clip 110 in order that the clip freely rides in the slot. One leg of the L-shaped clip forms a downwardly directed lip overhanging the front face 9 of the front leg 107.

As is apparent from the figures, the foot 117 and front leg 107 of base 103 are integrally formed of thin plastic. Three ridges 176 extend along the rear face 111 of base 103, which ridges define a generally vertical surface.

As shown in FIGS. 8 and 9, in use with single walled tray 81, the front face 9 of carrier 100 may be placed in abutment with the curved rear wall 89 of the tray after raising clip 110. Thereafter, the clip may be lowered so that its downwardly extending lip extends over wall 89 of the tray. The carrier 100 is then attached to the tray 81. The carrier may be removed by simply once more raising clip 110. If the carrier 100 is to be used with a double-walled tray, optionally, pin 172 may be withdrawn in order to remove the clip from the carrier. Thereafter, carrier 100 may be used in the same manner as was described in connection with carrier 10 when used with a double-walled tray (of FIGS. 3 and 5).

Figure 11:
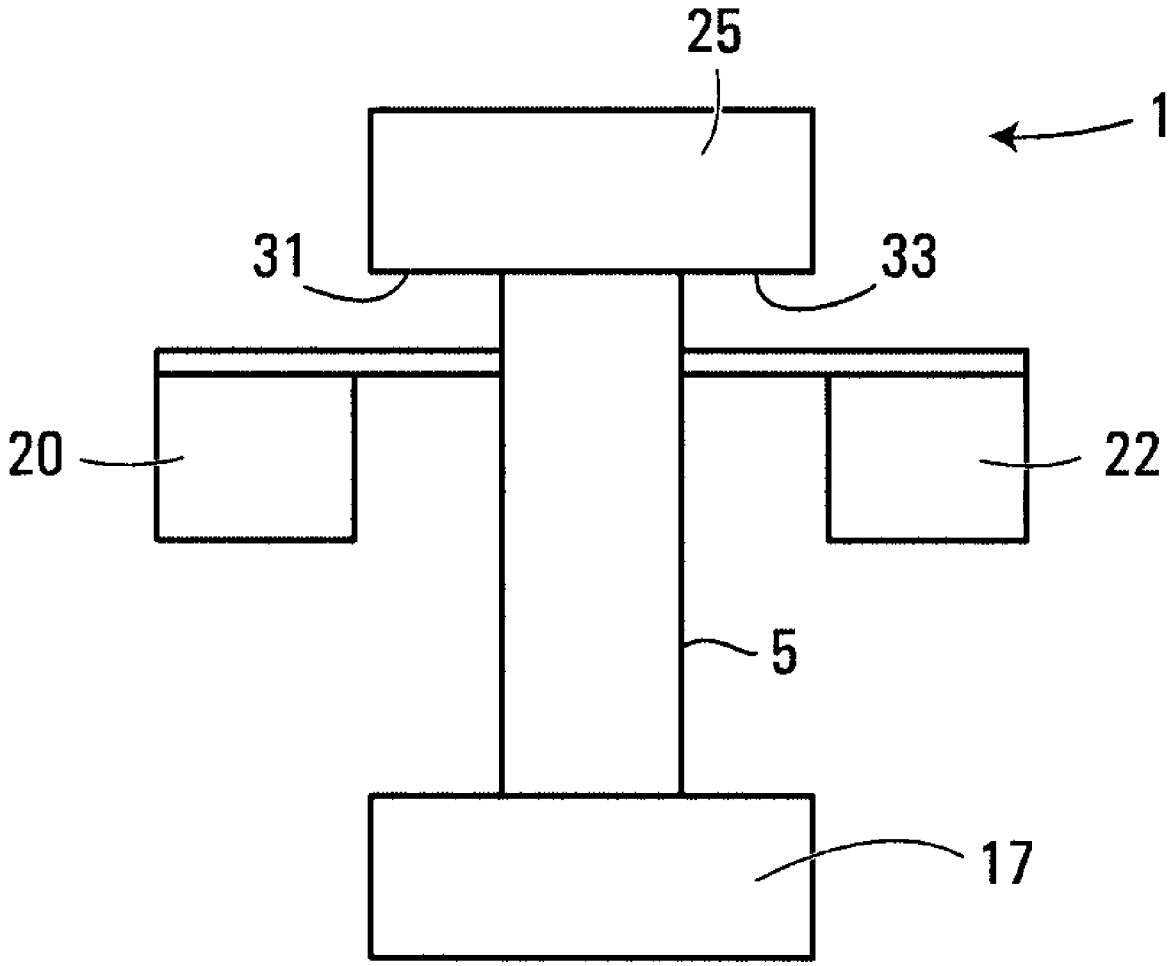
FIG. 11 shows a rear view of a carrier in accordance with another embodiment of the present invention.

FIG. 11 shows a rear view of an embodiment of a carrier 1 and like features are designated by common reference numerals. The carrier further includes at least one holder 20, 22 supported by and extending from the carrier arm 5 and which may be adapted to support at least one of a paint can and a beverage container such as a cup, mug or flask. Advantageously, the base 17 of the carrier supports the weight of the container(s) independently of the tray.

The base and lifting member (e.g. the carrier arm) may be formed of any suitable material or combination thereof, including plastics, metal or wood. In one embodiment, the lifting member may be arranged to swivel relative to the coupler so that any angled upper portion of the arm which for example provides a carrying handle or is used for supporting the handle of a paint roller can be rotated away from an overhanging position above the tray.

Modifications and changes to the embodiments described herein will be apparent to those skilled in the art.

What is claimed is:

1. A carrier for a paint tray, comprising:

a generally L-shaped base having an upwardly extending front leg and a rearwardly extending basal leg, a bottom portion of said front leg being connected to said basal leg, said front leg having a top edge which is above said bottom portion;

a lifting member extending upwardly from said basal leg of said base in spaced relation from said front leg, said lifting member meeting said basal leg rearwardly of said front leg, said lifting member having a longitudinal slot;

said upwardly extending front leg having a concave front face such that a middle portion of said front face between said top edge and said bottom portion is disposed rearwardly of said bottom portion, said front face facing away from said lifting member; and a clip with a downwardly directed lip riding in said slot, said clip dimensioned, and said slot having such a length, that said clip may be moved downwardly so that said downwardly directed lip extends below said top edge of said front leg and in front of said front face of said front leg.

2. The carrier of claim 1 wherein said clip is freely slidable along said slot.

3. The carrier of claim 2 wherein said clip is releasably held to said slot with a removable pin.

4. The carrier of claim 1 wherein said front leg rigidly extends from said base.

5. The carrier of claim 4 wherein said lifting member terminates in a receptor for holding a paint roller handle.

6. The carrier of claim 5 wherein said receptor is a notch.

7. The carrier of claim 4 wherein said front leg has a rear face defining a generally vertical surface.

8. The carrier of claim 4 wherein said top edge of said front leg is a ledge.

9. The carrier of claim 7 wherein said lifting member supports a paint can holder.

10. The carrier of claim 7 wherein said lifting member is an angulated rod extending from said base.

11. A carrier for a paint tray of the type having a curved wall defining a container for containing paint and a rim extending from an upper portion of the wall, the carrier comprising:

a generally L-shaped base having an upwardly extending front leg terminating in a top ledge, said front leg having a bottom portion below said top ledge connected to a rearwardly extending basal leg;

a lifting member extending upwardly from said basal leg of said base in spaced relation from said front leg, said lifting member having a longitudinal slot;

said upwardly extending front leg having a concave front face such that a middle portion of said front face between said top edge and said bottom portion is disposed rearwardly of said bottom portion, said front face facing away from said lifting member;

said concave front face for engaging said curved wall of the paint tray with said ledge engaging a lower surface of the rim extending from said wall; and a clip with a downwardly directed lip for retaining said base in engagement with said tray, said clip sliding in said longitudinal slot of said lifting member, said clip dimensioned, and said slot having such a length, that said clip may be moved downwardly so that said downwardly directed lip extends below said top ledge of said front leg and in front of said front face of said front leg.

* * * * *

UNITED STATES PATENT AND TRADEMARK OFFICE

CERTIFICATE OF CORRECTION

PATENT NO. : 7,575,261 B2
APPLICATION NO. : 11/419094
DATED : August 18, 2009
INVENTOR(S) : Gagne et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 318 days.

Signed and Sealed this

Seventh Day of September, 2010

David J. Kappos

David J. Kappos
*Director of the United States Patent and Trademark Office*